US005248072A

United States Patent [19]

Jones

[11] Patent Number: 5,248,072

[45] Date of Patent: Sep. 28, 1993

[54] BELT SUSPENDED TOOL HOLSTER

[76] Inventor: Jerry F. Jones, P.O. Box 42, Comins, Mich. 48619

[21] Appl. No.: 883,464

[22] Filed: May 15, 1992

[51] Int. Cl.[5] ..... A45F 5/00

[52] U.S. Cl. ..... 224/247; 224/253; 224/904

[58] Field of Search ..... 224/253, 247, 248, 904, 224/252; 81/DIG. 1

[56] References Cited

U.S. PATENT DOCUMENTS

| | | | |
|---|---|---|---|
| 3,104,434 | 9/1963 | Noordhoek | 224/904 |
| 3,168,971 | 2/1965 | Goertzen | 224/247 |
| 3,450,317 | 6/1969 | Ramer | 224/904 |
| 3,599,847 | 8/1971 | Danielson | 224/904 |
| 4,569,466 | 2/1986 | Webber | 224/253 |
| 4,645,104 | 2/1987 | Vokaty | 224/904 |

*Primary Examiner*—Linda J. Sholl
*Attorney, Agent, or Firm*—William F. Hamrock

[57] ABSTRACT

A belt suspended tool holster for T-shaped tools including an upper flat sleeve with two J-shaped support members descending therefrom. Each J-shaped support member has an inner and outer vertical arm joined together by a bulb shaped base. Said inner arm descends downwardly and said outer arm extends upwardly and curves inwardly towards said inner arm forming a flexible tensioned jaw and tool head opening to receive and release the T-shaped tool head. The J-shaped support members are spaced apart allowing the tool handle to pass through with the tool head clasped in place while supported on the bulb shaped base.

13 Claims, 3 Drawing Sheets

BELT SUSPENDED TOOL HOLSTER

BACKGROUND OF THE INVENTION

1. Field of the Invention

The present invention generally relates to a belt suspended tool holster, and more particularly, to an adjustable holster for supporting various tools such as T-shaped hammers, various T-shaped tools and other types of variously shaped devices.

2. Description of the Prior Art

Various types of belt supported hammer holders are known in the prior art. In general, these holders have a waist belt supporting device and various types of supports for holding the hammer. Many of these holders because of their structures are restricted to holding only one size hammer. Other holsters require cumbersome hand movements to insert the hammer and/or to release it from the holder. In many instances, a two-hand operation is required to remove the hammer from the holder.

U.S. Pat. No. 3,599,847 discloses a belt suspended hammer holder that includes an L-shaped bracket wherein the vertical portion is supported by the belt. The horizontal portion forms two legs having an opening therebetween to receive and support the hammer. The hammer is removed by lifting it out of the opening with lateral hand movements.

U.S. Pat. No. 4,645,104 discloses a belt suspended T-shaped tool holder having a tool front head receiving member and a tool tail receiving member having an opening therebetween to receive the handle. The tool front head receiving member is barrel-shaped to receive the tool front head but is restricted to the size of the front head such as the front head of a hammer and cannot be used with tools of a different configuration. The tail receiving member is U-shaped for guiding the front head into the barrel-shaped receiving member and for supporting the tail. Complicated hand movements are required to insert and remove the tool. This holder would require a special front head holder of specific dimensions for each tool.

None of the prior art provides a belt holster for T-shaped tools or other variously shaped devices as herein provided, which can be operated with one hand, provides means to clasp the tool head or body components firmly in place, can be adjusted to be used with various types of T-shaped tools and devices or device and holds the tool in a convenient position for use by the user.

SUMMARY OF THE INVENTION

It is an object of the present invention to provide a belt suspended holster for various T-shaped tools such as hammers, mason trowels, dry wall knives, paint brushes and squeegees as well as variously shaped devices such as tape measures which can be removed from the holster with one hand.

It is a further object to provide a belt suspended holster which clasps the T-shaped tool head components or body structure firmly in place.

It is another object to provide a belt suspended holster in which the tool can be inserted and removed without difficulty.

It is another further object to provide a belt suspended holster which can be adjusted to fit and to hold the variously configured head components of T-shaped tools or devices.

The belt-suspended T-tool holster of the present invention includes a vertical flat sleeve having grooved slots therein for receiving a user's belt and having a pair of J-shaped support members extending from the flat sleeve for supporting T-shaped tools and devices. The J-shaped support members are disposed in adjacent spaced apart relationship to one another forming an opening for the handle of T-shaped tools therebetween. Each J-shaped member includes inner and outer vertical arms descending into and forming an interior bulb shaped base support therebetween. The inner vertical arm is integral with the flat sleeve and descends therefrom. The outer vertical arm extending upwardly from the bulb shaped support curves inwardly towards the inner vertical arm to form a flexible tensioned jaw and opening therewith and in conjunction with said bulb shaped base support receives and releases the individual front or back end components of the T-shaped tool head while securely clasping the tool head. The T-shaped tool handle passes through the handle opening formed between the spaced apart J-shaped members. Likewise devices such tape measures are securely clasped and held firmly in a similar manner.

BRIEF DESCRIPTION OF THE DRAWINGS

Although such novel features believed to be characteristic of the invention are pointed out in the claims, the invention and the manner in which it may be carried out may be further understood by reference to the following disclosure and to the accompanying drawings.

DESCRIPTION OF THE PREFERRED EMBODIMENT

The belt suspended tool holster in accordance with the present invention in not merely another belt suspended holder for a hammer. The tool holster disclosed herein is is designed and fabricated to hold not only hammers but also other T-shaped tools as well as many other devices such as tape measures.

A unique feature of the present invention is that the pair of adjacent J-shaped tool support members can be adjusted individually. the result of this feature is that the present tool holster possesses numerous advantages which distinguishes it from prior art tool holders.

By having each J-shaped tool support member adjustable, each support member can be reformed to apply holding pressure to differently shaped components of the tool. For example, if the front and rear portions of a tool or device to be supported are of different sizes, each of the J-shaped support members can be adjusted to apply holding pressure to firmly clasp the front or rear portion and prevent the tool or device from becoming loosely secured and falling out of the tool support.

A further advantage of the present invention is the efficient and easy operation of the present tool holster. The present holster is so designed and fabricated that tools and devices easily slip into place therein while requiring the user to use only one hand in doing so. Further, even though the tools and devices are held firmly clasped within the holster, they can be easily removed with one hand.

Figure 1:
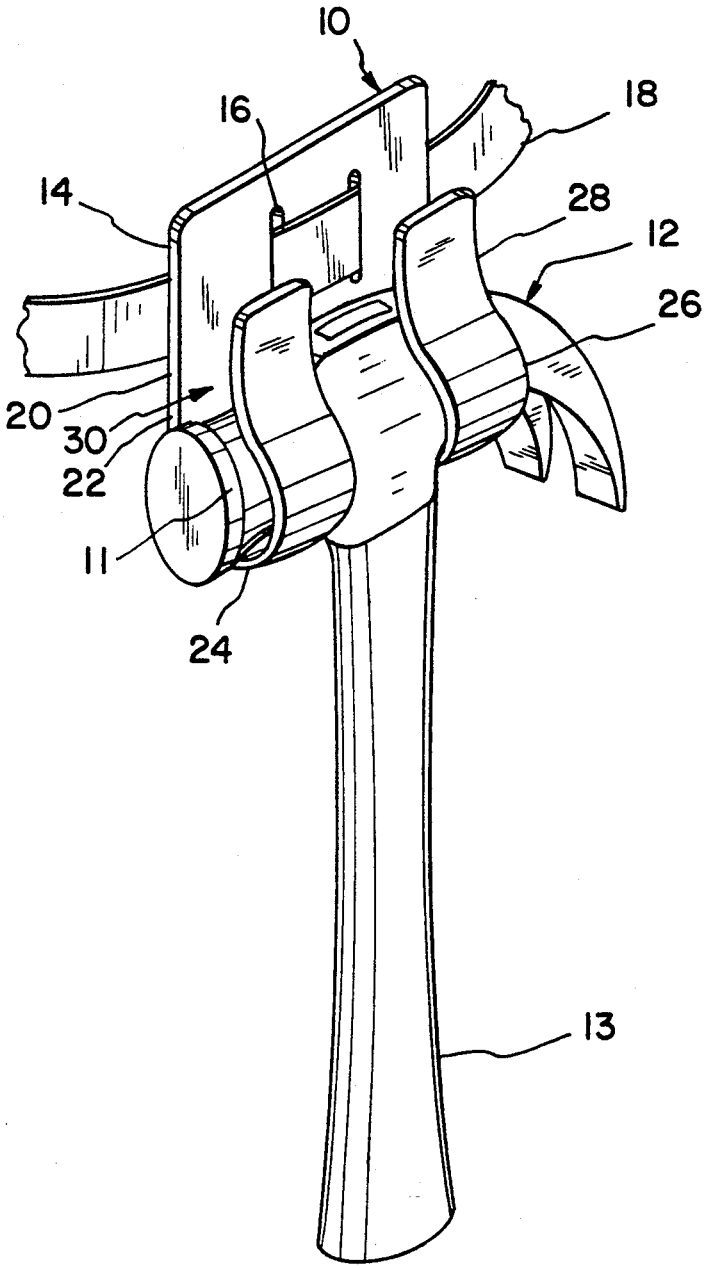
FIG. 1 is a perspective view of a preferred embodiment of the tool holster of the invention showing a hammer and user's belt in place.

Referring to the drawings, and in particular FIG. 1, thereof, the structure and operation of the belt suspended holster 10 of this invention are shown holding a conventional claw hammer 12. Other tools having a similar configuration with an elongated handle supporting a projecting head member such as a mason trowel, a drywall knife, paint brushes, squeegees, and devices such as tapemeasures, etc. can likewise be supported.

The principal elements of belt suspended holster 10 include an upper vertical flat sleeve 14 provided with parallel slots 16 for receiving a user's belt 18 or similar attachment. A pair of J-shaped tool support members 20 are secured to flat sleeve 14. Each J-shaped support member 20 includes inner vertical arm 22 connected by bulb shaped base support 24 to space opposed outer arm 26.

Inner vertical arm 22 is attached to flat sleeve 14 and descends into bulb shaped base support 24. Outer vertical arm 26 ascends from the bulb shaped base support 24 extending upwardly to form a flexible tensioned jaw 28 and opening 30. The head 11 of hammer 12 is shown secured within bulb shaped base support 24 with its handle 13 descending therefrom.

Figure 2:
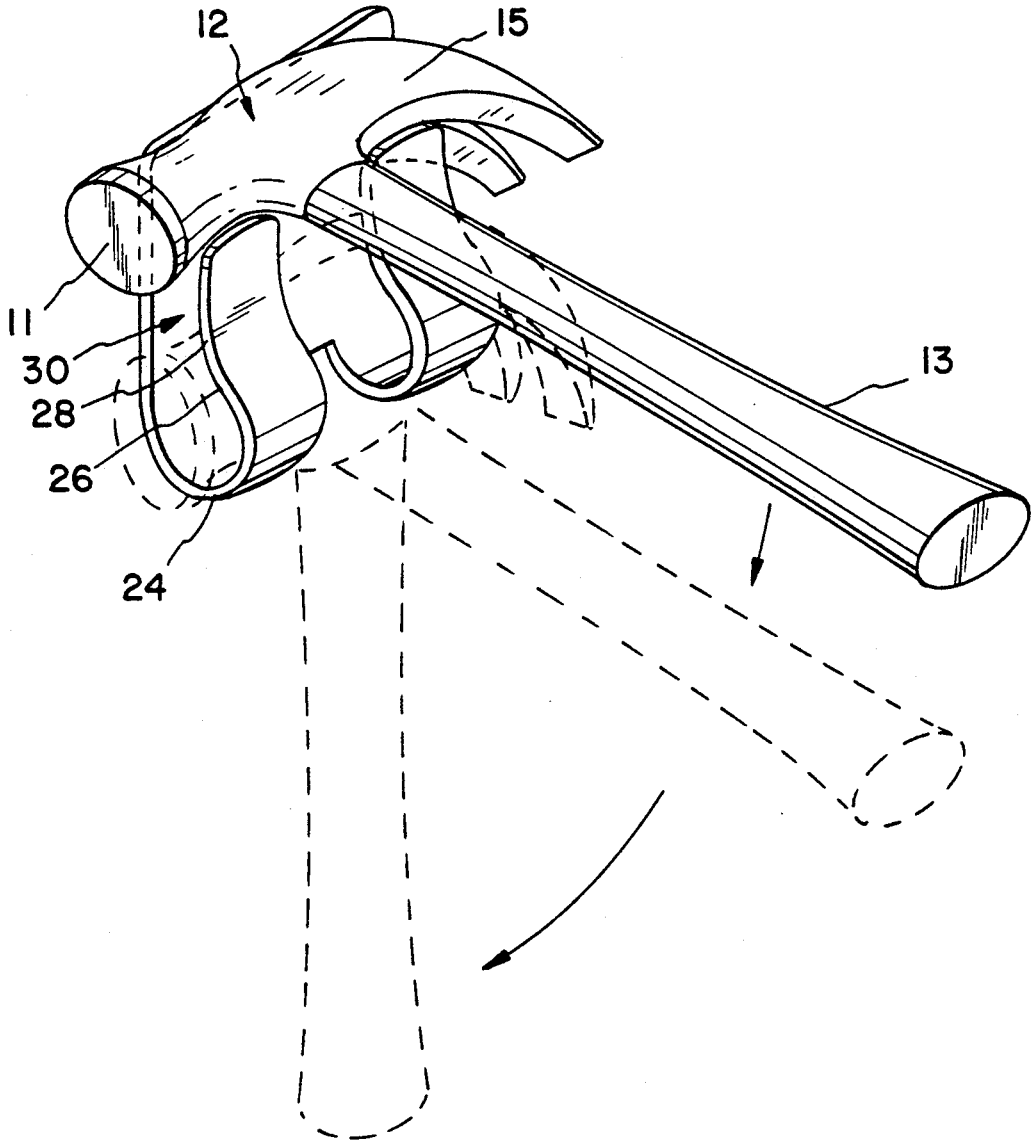
FIG. 2 is a perspective view of the tool holster illustrating the movement of placing the hammer into the holster.

FIG. 2 is an illustration of the preferred manner of inserting a hammer 12 into holster 10. The hammer handle 13 is held out horizontally with the front head portion and rear head portion thereof being pressed downwardly into opening 30 through the flexible tensioned jaws 28 and into bulb shaped base supports 24. The hammer handle is then allowed to drop to a vertical position as shown in phantom. Bulb shaped base support 24, outer vertical arm 26 and flexible tensioned jaw 28 are adjusted to snugly enclose the individual structures of the front head 11 portion and the rear head 15 portion of the tool. When holster 10 contains thermoplastic material this is accomplished by previously heating the material such as at the bulb shaped base support 24 and reforming the holster J-shaped members 20 to the desired configuration of the tool head components. When the holster is made of metal or wire materials, these materials can be bent or otherwise manipulated to fit the individual configurations of the tool head components.

Figure 4:
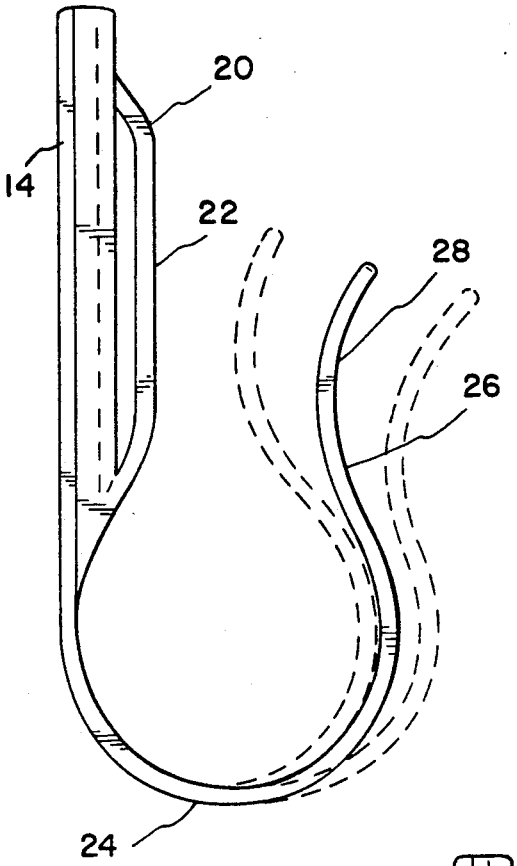
FIG. 4 is a side view of the J-shaped supporting member illustrating the various adjustments of the outer arm and bulb to clasp different size tools.
Figure 3:
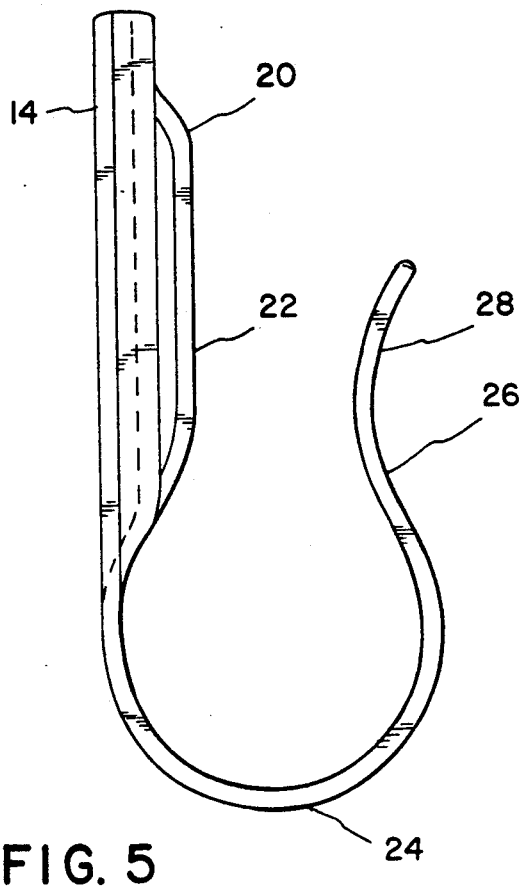
FIG. 3 is a side view of the J-shaped supporting member.

The side view of holster 10 in FIG. 4 illustrates reforming bulb shaped base support 24, outer vertical arm 26 and flexible tensioned jaw 28 to different configurations in phantom to fit the individual configuration of the tool components. FIG. 3 is similar to FIG. 4 and depicts the outer vertical arm and jaw in a typical configuration.

FIG. 2 is also an illustration of a preferred manner of removing hammer 12 from holster 10 by reversing the procedure. In removing the hammer from the holster, the hammer handle is rotated to a horizontal position generally about 90° within the bulb shaped base support 24 and is then moved upwardly in the same horizontal position so that the front head portion and rear head portion pass through the flexible tensioned jaws 28.

Figure 5:
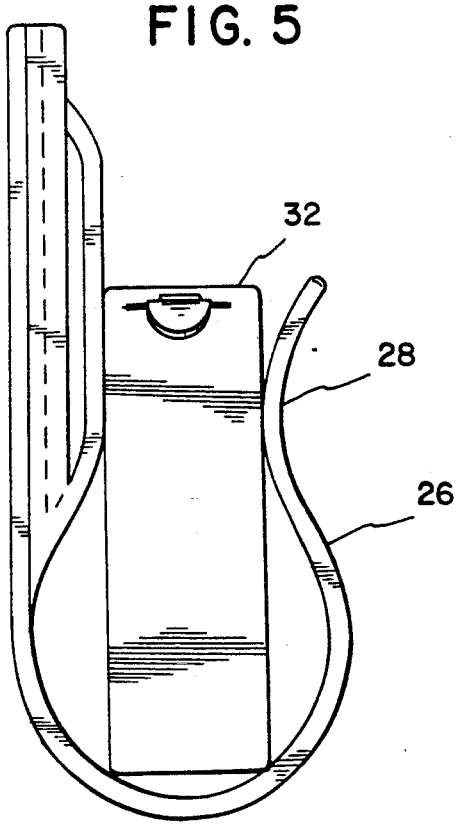
FIG. 5 is a perspective view of the tool holster clasping a tape measure device.

Referring to FIG. 5, tape measure 32 device is shown being clasped firmly within flexible tensioned jaws 28 and outer vertical arm 26. The tape measure can be easily removed and replaced therein.

It will be understood by those skilled in the art that holster 10 is an efficient and durable tool holder for various T-shaped tools allowing the user to operate the holster by using only one hand and still being able to hold the tool firmly secured while in the holster.

It will further be understood by those skilled in the tool holder art that various modifications may be made in holster 10 without departing from the spirit and scope of the invention.

What is claimed is:

1. A belt suspended plastic tool holster for T-shaped tools have a horizontally disposed tool head providing front and back end components which tool head is centrally mounted on a vertical tool handle descending therefrom, and other articles, and tool holster comprising:

an upper vertical flat planar sleeve provided with means to mount the sleeve on a user's belt, two identical-shaped support members, each defining an inner and outer vertical arm joined together by bulb shaped base support, said inner vertical arm mounted on a front face of said flat sleeve and descending downwardly and inwardly therefrom, said outer vertical arm extending upwardly and curving inwardly towards said inwardly extending inner vertical arm, forming a flexible tensioned jaw and tool head opening with the inner vertical arm, to receive and to release the front and back end components of said tool head, said J-shaped support members disposed in adjacent spaced locations to one another of sufficient distance to allow the tool handle to pass therethrough and to allow each individual front and back end component of the tool head to be individually clasped in place by said flexible tensioned jaw and said bulb shaped base support by adjusting said jaw and said base support to fit the individual tool head components.

2. A tool holster according to claim 1 wherein said bulb shaped base, said jaw and said tool head opening can be adjusted to fit said tool head front and back end components.

3. A tool holster according to claim 1 wherein said plastic material can be heated to be adjusted to fit said tool head components.

4. A tool holster according to claim 1 wherein said bulb shaped base support is integrally joined to said inner and outer vertical arms.

5. A tool holster according to claim 1 wherein said sleeve contains grooves for mounting on a user's belt.

6. A tool holster according to claim 5 wherein said grooves comprise parallel slots which the belt passes through.

7. A belt suspended T-shaped tool within a plastic tool holster comprising said T-shaped tool having a horizontally disposed tool head providing front end and back end components and a centrally mounted tool handle descending from the tool head, said tool holster comprising an upper vertical flat planar sleeve with means to mount said sleeve on a user's belt, two identical J-shaped support members each defining an inner and an outer vertical arm joined together by a bulb shaped base support, said inner vertical arm mounted on a front face of said flat sleeve and descending therefrom, said outer vertical arm extending upwardly and curving inwardly towards said inner vertical arm forming a flexible tensioned jaw and tool head opening with the vertical arm which receives and releases the front and back end components of said tool head, said J-shaped support members disposed in adjacent spaced locations to one another of sufficient distance which allows the tool handle to pass therethrough and allows each individual front and back end component of the tool head to be individually clasped in place by said flexible tensioned jaw and said bulb shaped base support by adjusting said jaw and said base support to fit the individual tool head component.

8. A tool holster according to claim 7 wherein said bulb shaped base support said jaw and said tool head opening can be individually adjusted to fit said tool head front and back end components.

9. A tool holster according to claim 7 wherein said plastic material can be heated to be adjusted to fit said tool head components.

10. A tool holster according to claim 7 wherein said bulb shaped base support is integrally joined to said inner and outer vertical arms.

11. A tool holster according to claim 7 wherein said sleeve contains grooves for mounting on a user's belt.

12. A tool holster according to claim 11 wherein said grooves comprise parallel slots which the belt passes through.

13. A T-shaped tool according to claim 7 wherein the T-shaped tool is a hammer.

* * * * *